US007019202B1

(12) United States Patent
Hetzel

(10) Patent No.: US 7,019,202 B1
(45) Date of Patent: Mar. 28, 2006

(54) ACOUSTIC GUITAR WITH REVERBERATING BRIDGE ASSEMBLY

(76) Inventor: Robert Hetzel, 841 Castleton Ave., Staten Island, NY (US) 10310

( * ) Notice: Subject to any disclaimer, the term of this patent is extended or adjusted under 35 U.S.C. 154(b) by 67 days.

(21) Appl. No.: 10/867,290

(22) Filed: Jun. 14, 2004

(51) Int. Cl.
*G10D 3/00* (2006.01)

(52) U.S. Cl. ..... 84/299; 84/209

(58) Field of Classification Search ..... 84/299, 84/298, 209, 212, 307, 308, 309, 310, 313, 84/734
See application file for complete search history.

(56) References Cited

U.S. PATENT DOCUMENTS 4,228,715 A * 10/1980 Nourney ..... 84/734
5,295,427 A 3/1994 Johnsen ..... 84/307
5,497,690 A 3/1996 Soupios ..... 84/453
6,031,165 A 2/2000 Brekke ..... 84/298
6,420,639 B1 * 7/2002 Sherlock ..... 84/313
6,613,968 B1 * 9/2003 Devereaux et al. ..... 84/299

* cited by examiner

*Primary Examiner*—David Martin
*Assistant Examiner*—Jianchun Qin
(74) *Attorney, Agent, or Firm*—Goldstein Law Offices, P.C.

(57) ABSTRACT

An acoustic guitar having a reverberating bridge assembly mounted onto the body of the guitar for re-echoing and reverberating the sounds produced by the strings of the guitar, in order to increase the range of sound effects that the guitar is capable of producing. The reverberating bridge assembly comprises a tailpiece having a transverse crevice, a U-shaped tube support positioned within the crevice, and a hollow cylindrical tube supported upon the U-shaped tube support. The strings of the guitar press upon the cylindrical tube. When a player plucks the strings, vibrations of the strings reverberate within the tube, and are transmitted therefrom to the U-shaped tube support, the tailpiece, and then to the body of the guitar. The reverberating bridge assembly produces sound having a delightful reverberating quality.

10 Claims, 3 Drawing Sheets

ACOUSTIC GUITAR WITH REVERBERATING BRIDGE ASSEMBLY

BACKGROUND OF THE INVENTION

1. Field of the Invention

The invention generally relates to an acoustic guitar, and in particular relates to an acoustic guitar having a reverberating bridge assembly for reverberating the sounds produced by the strings of the guitar.

2. Description of the Related Art

Guitars are played by tens of millions of individuals worldwide. A great many different types of guitars have been devised to suit the varied preferences of these different individuals. Electric guitars are typically provided with accessories for enabling a player to electronically adjust various parameters of the sound produced by the strings of the guitars, including accessories for enabling a player to "reverberate" the sounds produced by the strings of the guitar. Reverberation is an effect caused by the re-echoing of sound waves, generally caused by a reflection of the sound waves upon different surfaces.

However, acoustic guitars, which do not rely on electrical amplification, are more limited in their abilities to produce sounds other than that which emits from a normally vibrating nylon or steel string of the guitar, and in particular, are not capable of reverberating the sounds produced by the strings of the guitar. Accordingly, there is a need for an acoustic guitar having a reverberating bridge assembly for re-echoing and reverberating the sounds produced by the strings of the guitar, in order to increase the range of sound effects that the guitar is capable of producing.

A variety of apparatuses have been devised for altering the sounds produced by a guitar. For example, U.S. Pat. No. 4,228,715 to Nourney appears to show a strain gauge for use as an electrical pickup for a string instrument. Additionally, U.S. Pat. No. 6,031,165 to Brekke appears to show an adjustable bridge that is used to raise or lower all of the strings on a stringed instrument. Moreover, U.S. Pat. No. 5,295,427 to Johnsen appears to show a bridge for a stringed instrument, having a base member and an adjusting mechanism for adjusting the vertical height of the strings relative to the belly of the stringed instrument. Furthermore, U.S. Pat. No. 6,420,639 to Sherlock appears to show a vibrato apparatus for a stringed instrument for creating a vibrato sound which results from rapid raising or lowering of pitch during vibration of the strings. In addition, U.S. Pat. No. 5,497,690 to Soupios appears to show a string-vibration enhancer for instruments of the guitar family, for producing a sound which is similar to that produced by a fretless bass or a sitar. What's more, U.S. Pat. No. 6,613,968 to Deveraux et al appears to show a guitar bridge and tailpiece for use in facilitating the tuning procedure for a guitar.

While these devices may be suitable for the particular purpose employed, or for general use, they would not be as suitable for the purposes of the present invention as disclosed hereafter.

SUMMARY OF THE INVENTION

It is an object of the invention to provide an acoustic guitar that is capable of reverberating the sounds produced by the strings of the guitar. Accordingly, the acoustic guitar has a reverberating bridge assembly for re-echoing and reverberating the sounds produced by the strings of the guitar, and thereby increases the range of sound effects that the guitar is capable of producing.

It is another object of the invention to produce an acoustic guitar having a reverberating bridge assembly which is capable of increasing the level of reverberation of the higher pitched strings while leaving the level of reverberation of the lower pitched strings relatively unaffected. Accordingly, the reverberating bridge assembly substantially increases the level of reverberation of the higher pitched strings E, B, G, and D, while leaving the level of reverberation of the lower pitched strings, A and E, relatively unaffected.

It is yet another object of the invention to produce an acoustic guitar with a reverberating bridge assembly that does not greatly contribute to the price of the guitar. Accordingly, the reverberating bridge assembly is fashioned from readily available materials, and does not greatly contribute to the price of the guitar.

Further objects of the invention will become apparent in the detailed description of the invention that follows.

The invention is an acoustic guitar having a reverberating bridge assembly mounted onto the body of the guitar for re-echoing and reverberating the sounds produced by the strings of the guitar, in order to increase the range of sound effects that the guitar is capable of producing. The reverberating bridge assembly comprises a tailpiece having a transverse crevice, a U-shaped tube support positioned within the crevice, and a hollow cylindrical tube supported upon the U-shaped tube support. The strings of the guitar press upon the cylindrical tube. When a player plucks the strings, vibrations of the strings reverberate within the tube, and are transmitted therefrom to the U-shaped tube support, the tailpiece, and then to the body of the guitar. The reverberating bridge assembly produces sound having a delightful reverberating quality.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
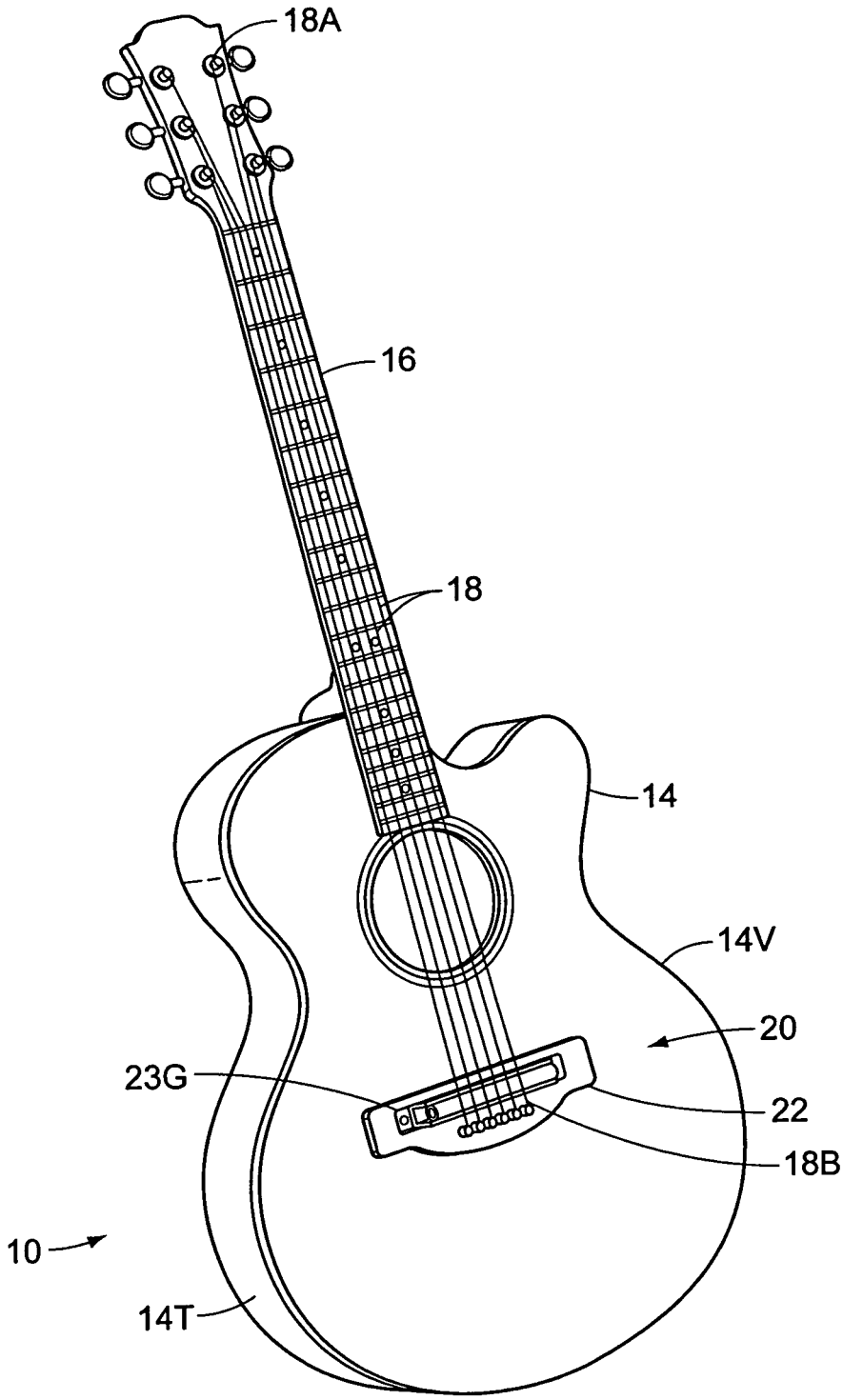
FIG. 1 is a perspective view of an acoustic guitar with reverberating bridge assembly.

FIG. 1 illustrates an acoustic guitar 10 according to the present invention, comprising a substantially hollow body 14 having first lateral side 14T and a second lateral side 14V, a neck 16, and six strings 18. Each of the strings 18 has a first end 18A which is anchored to the neck 16, and a second end 18B which is anchored to the body 14. The acoustic guitar 10 further comprises a reverberating bridge assembly 20 for reverberating the sounds produced by the strings 18 of the guitar 10.

Figure 2:
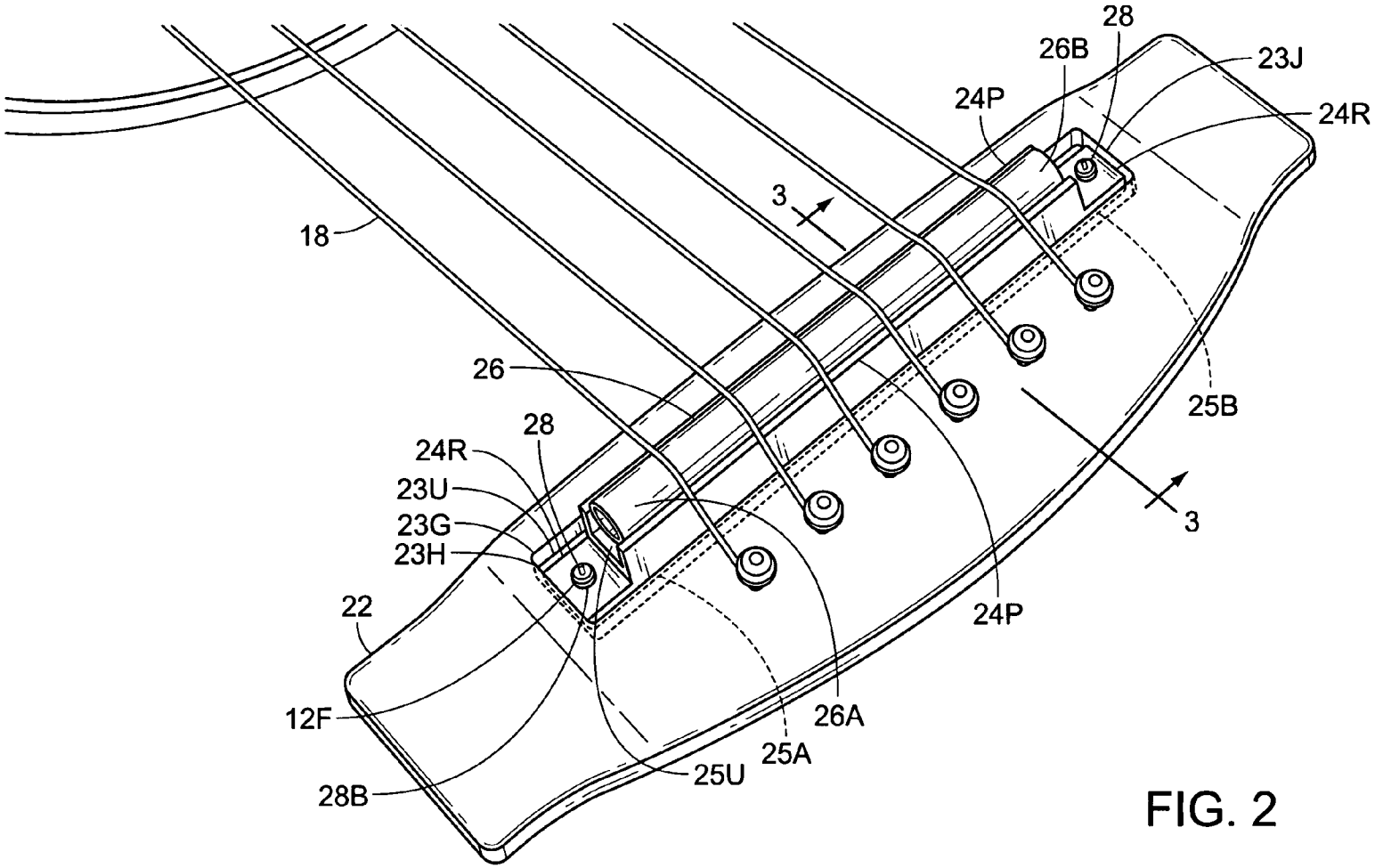
FIG. 2 is a perspective view of the reverberating bridge assembly.

FIG. 2 illustrates the reverberating bridge assembly 20 in greater detail. The reverberating bridge assembly 20 is mounted onto the body 14 of the guitar 10 for re-echoing and reverberating the sounds produced by the strings 18 of the guitar 10, and thereby increases the range of sound effects that the guitar 10 is capable of producing. The reverberating bridge assembly 20 generally comprises a tailpiece 22 having a transverse crevice 23G having an upper surface 23U, a U-shaped tube support 24 positioned upon the upper surface 23U of the crevice 23G, and a hollow cylindrical tube 26 supported upon the U-shaped tube support 24. The strings 18 of the guitar 10 press upon the hollow cylindrical tube 26. When a player plucks the strings 18, vibrations from the strings 18 reverberate within the tube 26, and are transmitted therefrom to the U-shaped tube support 24, and from there to the tailpiece 22, and then to the hollow body 14 of the guitar 10. The reverberating bridge assembly 20 produces sound having a delightful reverberating quality.

The substantially rectangular transverse crevice 23G has a first end 23H closer to the first lateral side 14T of the body 14, and has a second end 23J closer to the second lateral side 14V of the body 14. The elongated U-shaped tube support 24 has a base 25 having a first end 25A, a second end 25B, an upper surface 25U, and has two elongated and spaced prongs 24P extending perpendicularly upward from the upper surface 25U of the base 25, substantially from the first end 25A to the second end 25B of the base 25. The base 25 of the U-shaped tube support 24 extends substantially from the first end 23H to the second end 23J of the transverse crevice 23G. The transverse crevice 23G extends deeply into the tailpiece 22, in order that the upper surface 23U of the crevice 23G is separated from the body 14 of the guitar 10 by only a minimal distance. This feature enhances the sound produced by the reverberating bridge assembly 20.

The hollow cylindrical tube 26 is supported upon the prongs 24P of the tube support 24 at an elevated position above the upper surface 25U of the base 25 of the U-shaped tube support 24. The tube 26 extends substantially from the first end 25A to the second end 25B of the base 25 of the tube support 24. The tube 26 has a first end 26A closer to the first lateral side 14T of the body 14, and has a second end 26B closer to the second lateral side 14V of the body 14. The tube 26 is open at both ends, 26A and 26B.

Figure 3:
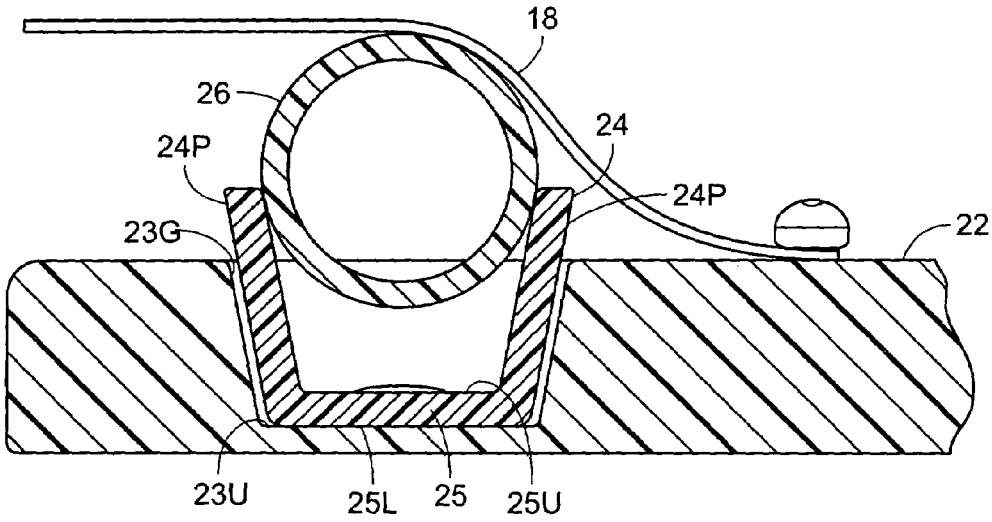
FIG. 3 is a cross-sectional view through the reverberating bridge assembly.

The base 25 of the U-shaped tube support 24 has an attachment tab 24R at each of the ends, 25A and 25B. Each of the attachment tabs 24R has a threaded circular opening 12F extending fully therethrough. The reverberating bridge assembly 20 is provided with two threaded adjusting screws 28, each having a head 28H and a flat bottom 28B. Turning momentarily to FIG. 3, the base 25 of the U-shaped tube support 24 has a lower surface 25L. The lower surface 25L of the base 25 of the U-shaped tube support 24 does not rest directly upon the upper surface 23U of the crevice 23G, but rather, is separated therefrom by a small, variable distance, in order to further enhance the reverberation effect afforded by the hollow, cylindrical tube 26. The adjusting screws 28 are used for selectively varying the distance of separation between the upper surface 23U of the crevice 23G, and the lower surface 25L of the base 25 of the U-shaped tube support 24. In particular, when the adjusting screws 28 are tightened with a tool such as a screwdriver, the screws 28 do not move downward. Rather, the U-shaped tube support 24 moves upward upon the adjusting screws 28, thereby increasing the distance of separation between the upper surface 23U of the crevice 23G, and the lower surface 25L of the base 25 of the U-shaped tube support 24. The extent of said distance of separation is directly proportional to the reverberation effect of the reverberating bridge assembly 20. The flat bottoms 28B of the adjusting screws 28 rest upon the upper surface 23U of the crevice 23G. The flat bottoms 28B ensure that the pressure exerted upon the reverberating bridge assembly 20 by the strings 18 do not cause the adjusting screws 28 to penetrate or otherwise damage the tailpiece 22 or the body 14 of the guitar 10.

The reverberating bridge assembly 20 substantially increases the level of reverberation of the higher pitched strings E, B, G, and D while leaving the level of reverberation of the lower pitched strings, A and E, relatively unaffected. This generally provides a guitar 10 having a unique sound quality. In particular, when a player is playing various chords which utilize the lower pitched strings, A and E, this effect leaves the notes produced by the A string and the lower E string unaffected, while providing a reverberation effect for the notes produced by the higher pitched strings, the high E, B, G, and D, of the chord.

The tailpiece 22 is preferably constructed from wood. The U-shaped tube support 24 is preferably constructed from a metal. The hollow cylindrical tube 26 is also preferably constructed from a metal, and in particular is preferably constructed from an alloy of chromium and steel.

In use, one uses the acoustic guitar 10 in much the same way as one would use an "ordinary" acoustic guitar. However, the reverberating bridge assembly 20 substantially increases the level of reverberation of the higher pitched strings E, B, G, and D, while leaving the level of reverberation of the lower pitched strings, A and E, relatively unaffected, thereby providing a guitar 10 having a unique sound quality.

In conclusion, herein is presented an acoustic guitar having a reverberating bridge assembly for reverberating the sounds produced by the strings of the guitar. The invention is illustrated by example in the drawing figures, and throughout the written description. It should be understood that numerous variations are possible, while adhering to the inventive concept. Such variations are contemplated as being a part of the present invention.

What is claimed is:

1. An acoustic guitar having reverberation capabilities, comprising:

a substantially hollow body having a first lateral side and a second lateral side;

a neck extending from the body;

six strings, each having a first end which is anchored to the neck, and a second end which is anchored to the body;

a reverberating bridge assembly mounted onto the body for reverberating the sounds produced by the strings of the guitar, comprising:

a tailpiece having a first end closer to the first lateral side of the body, a second end closer to the second lateral side of the body, and a transverse crevice having an upper surface;

a U-shaped tube support positioned upon the upper surface of the crevice, said tube support having a base having a first end, a second end, an upper surface, and a lower surface, said tube support further having two elongated and spaced prongs extending upward from the upper surface of the base, substantially from the first end to the second end of the base; and a hollow cylindrical tube supported upon the prongs of the tube support at an elevated position above the upper surface of the base of the tube support, wherein the strings of the guitar press upon the hollow cylindrical tube, said tube having a first end closer to the first lateral side of the body, and a second end closer to the second lateral side of the body, and wherein the tube is open at both the first end and the second end of the tube; and wherein when a player plucks the strings, vibrations from the strings reverberate within the tube, and are transmitted therefrom to the U-shaped tube support, and from there to the tailpiece, and then to the hollow body of the guitar, in order to produce sound having a reverberating quality.

2. The acoustic guitar as recited in claim 1, wherein the base of the U-shaped tube support has an attachment tab at each of the ends of the base, wherein each of the attachment tabs has a threaded circular opening extending fully therethrough, wherein the reverberating bridge assembly is provided with two threaded adjusting screws, each having a head and a flat bottom, wherein the lower surface of the base of the U-shaped tube support is separated from the upper surface of the crevice by a small, variable distance, in order to further enhance the reverberation effect afforded by the hollow, cylindrical tube, wherein the adjusting screws are used for selectively varying the distance of separation between the upper surface of the crevice and the lower surface of the base of the tube support, wherein when the adjusting screws are tightened, the tube support moves upward upon the adjusting screws, thereby increasing the distance of separation between the upper surface of the crevice and the lower surface of the base of the tube support, wherein the extent of said distance of separation is directly proportional to the reverberation effect of the reverberating bridge assembly, wherein the flat bottoms of the adjusting screws rest upon the upper surface of the crevice and do not penetrate the tailpiece or the body of the guitar.

3. The acoustic guitar as recited in claim 2, wherein the tube extends substantially from the first end to the second end of the base of the tube support.

4. The acoustic guitar as recited in claim 3, wherein the base of the U-shaped tube support extends substantially from the first end to the second end of the transverse crevice.

5. The acoustic guitar as recited in claim 4, wherein the transverse crevice extends deeply into the tailpiece, in order that the upper surface of the crevice is separated from the body of the guitar by only a minimal distance, in order to enhance the sound produced by the reverberating bridge assembly.

6. The acoustic guitar as recited in claim 5, wherein the transverse crevice is substantially rectangular.

7. The acoustic guitar as recited in claim 6, wherein the U-shaped tube support is constructed from a metal.

8. The acoustic guitar as recited in claim 7, wherein the hollow cylindrical tube is constructed from a metal.

9. The acoustic guitar as recited in claim 8, wherein the hollow cylindrical tube is constructed from an alloy of chromium and steel.

10. The acoustic guitar as recited in claim 9, wherein the tailpiece is constructed from wood.

* * * * *